US009791178B2

(12) United States Patent
Morie

(10) Patent No.: US 9,791,178 B2
(45) Date of Patent: Oct. 17, 2017

(54) CRYOGENIC REFRIGERATOR

(71) Applicant: Sumitomo Heavy Industries, Ltd, Tokyo (JP)

(72) Inventor: Takaaki Morie, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 294 days.

(21) Appl. No.: 14/481,475

(22) Filed: Sep. 9, 2014

(65) Prior Publication Data

US 2015/0068221 A1 Mar. 12, 2015

(30) Foreign Application Priority Data

Sep. 10, 2013 (JP) ..... 2013-187407

(51) Int. Cl.

| | |
|---|---|
| ***F25B 9/06*** | (2006.01) |
| ***F16C 29/00*** | (2006.01) |
| ***F25B 9/14*** | (2006.01) |
| *F25B 9/10* | (2006.01) |

(52) U.S. Cl.
CPC . *F25B 9/14* (2013.01); *F25B 9/10* (2013.01)

(58) Field of Classification Search
CPC ..... F25B 9/06; F25B 2309/001; F25B 2309/004; F25B 2309/005; F16C 29/00; F16C 29/004; F16C 29/005; F16C 29/008
See application file for complete search history.

(56) References Cited

U.S. PATENT DOCUMENTS 3,625,015 A * 12/1971 Chellis ..... F25B 9/14 62/6
4,180,984 A 1/1980 Chellis
4,272,996 A * 6/1981 Sauerwein ..... B23D 49/162 30/394
4,333,755 A 6/1982 Sarcia
5,361,588 A * 11/1994 Asami ..... F25B 9/14 60/520
6,097,672 A * 8/2000 Kitahara ..... G04B 19/25353 368/35

(Continued)

FOREIGN PATENT DOCUMENTS

CN 2117572 U 9/1992
CN 201764746 U 3/2011

(Continued)

*Primary Examiner* — Grant Moubry
*Assistant Examiner* — Erik Mendoza-Wilkenfe
(74) *Attorney, Agent, or Firm* — Michael Best & Friedrich LLP

(57) ABSTRACT

In a cryogenic refrigerator, a scotch yoke mechanism includes an eccentric rotating body and a yoke plate that reciprocates by rotation of the eccentric rotating body. A displacer is connected to a yoke plate so as to reciprocate together with the yoke plate. A cylinder houses a displacer, and an expansion space for refrigerant gas is formed in a space with the displacer. An airtight container is provided on a high-temperature side of the cylinder and includes a housing space housing a scotch yoke mechanism and receive the refrigerant gas discharged from the expansion space. The airtight container includes a supporting unit that supports a side portion of the yoke plate so as to restrict tilting of the yoke plate around a rotary shaft of the eccentric rotating body.

4 Claims, 6 Drawing Sheets

(56) References Cited

U.S. PATENT DOCUMENTS

| | | | | |
|---|---|---|---|---|
| 6,810,589 | B2 * | 11/2004 | Lagaly | B23D 49/162 24/50 |
| 2011/0219810 | A1 * | 9/2011 | Longsworth | F25B 9/14 62/474 |
| 2012/0317994 | A1 | 12/2012 | Matsubara | |
| 2013/0108194 | A1 * | 5/2013 | Kikuchi | F16C 33/6648 384/13 |

FOREIGN PATENT DOCUMENTS

| | | | | |
|---|---|---|---|---|
| CN | 102829574 | A | 12/2012 | |
| GB | 2 098 308 | A | 11/1982 | |
| JP | S57-174663 | A | 10/1982 | |
| JP | H02-4168 | U | 1/1990 | |
| JP | H03-244967 | A | 10/1991 | |
| JP | H04-146529 | A | 5/1992 | |
| JP | H07-035070 | A | 2/1995 | |
| JP | 2001241796 | A | 9/2001 | |
| JP | 2004-144461 | A | 5/2004 | |
| JP | 2007-040137 | A | 2/2007 | |
| JP | 2010-060246 | A | 3/2010 | |
| JP | 2011-017457 | A | 1/2011 | |
| JP | 2013-083428 | A | 5/2013 | |
| JP | 2014-025652 | A | 2/2014 | |
| WO | WO-2011/089768 | A1 | 7/2011 | |
| WO | WO 2011123894 | A1 * | 10/2011 | F01B 9/023 |

* cited by examiner

CRYOGENIC REFRIGERATOR

RELATED APPLICATION

Priority is claimed to Japanese Patent Application No. 2013-187407, filed Sep. 10, 2013, the entire content of which is incorporated herein by reference.

BACKGROUND OF THE INVENTION

1. Field of the Invention

The present invention relates to a cryogenic refrigerator that includes a scotch yoke mechanism.

2. Description of the Related Art

A Gifford McMahon (GM) refrigerator is known as a refrigerator generating cryogenic temperature. The GM refrigerator changes volume of an expansion space by reciprocating a displacer inside a cylinder. In response to this volume change, the expansion space is selectively connected to a discharge side or an intake side of a compressor, thereby expanding refrigerant gas in the expansion space. To reciprocate the displacer, a known scotch yoke mechanism in which rotational movement of a crank rotated by a motor is converted to reciprocating movement may be used.

SUMMARY OF THE INVENTION

An object of the present invention is to provide a technique of reducing an entire length of a cryogenic refrigerator using a scotch yoke mechanism.

To achieve the above object, a cryogenic refrigerator according to the present invention includes: a scotch yoke mechanism that includes an eccentric rotating body and a yoke plate that reciprocates by rotation of the eccentric rotating body; a displacer connected to the yoke plate so as to reciprocate together with the yoke plate; a cylinder that houses the displacer and form an expansion space for refrigerant gas in a space with the displacer; and an airtight container provided on a high-temperature side of the cylinder, and that houses the scotch yoke mechanism and receive the refrigerant gas discharged from the expansion space. The airtight container includes a supporting unit that supports a side portion of the yoke plate so as to restrict tilting of the yoke plate around the rotary shaft of the eccentric rotating body.

DETAILED DESCRIPTION OF THE INVENTION

The invention will now be described by reference to the preferred embodiments. This does not intend to limit the scope of the present invention, but to exemplify the invention.

A scotch yoke mechanism is a mechanism that converts rotational movement of a crank to reciprocating movement. The scotch yoke mechanism includes a yoke plate that reciprocates by the rotational movement of the crank. It is widely applied to support a drive shaft connected in parallel to this reciprocating movement of the yoke plate by using a bearing. At this point, in the case where the drive shaft is formed long to secure sufficient drag force, the length of a GM refrigerator is also increased.

The GM refrigerator is used being incorporated inside a device or the like which utilizes, for example, superconductivity. In this case, the size of the refrigerator cannot be limitlessly increased because of constraints of the device where the refrigerator is incorporated, and particularly reduction of the entire length is demanded. In the following, an embodiment according to the present invention will be described with reference to the drawings.

Figure 1:
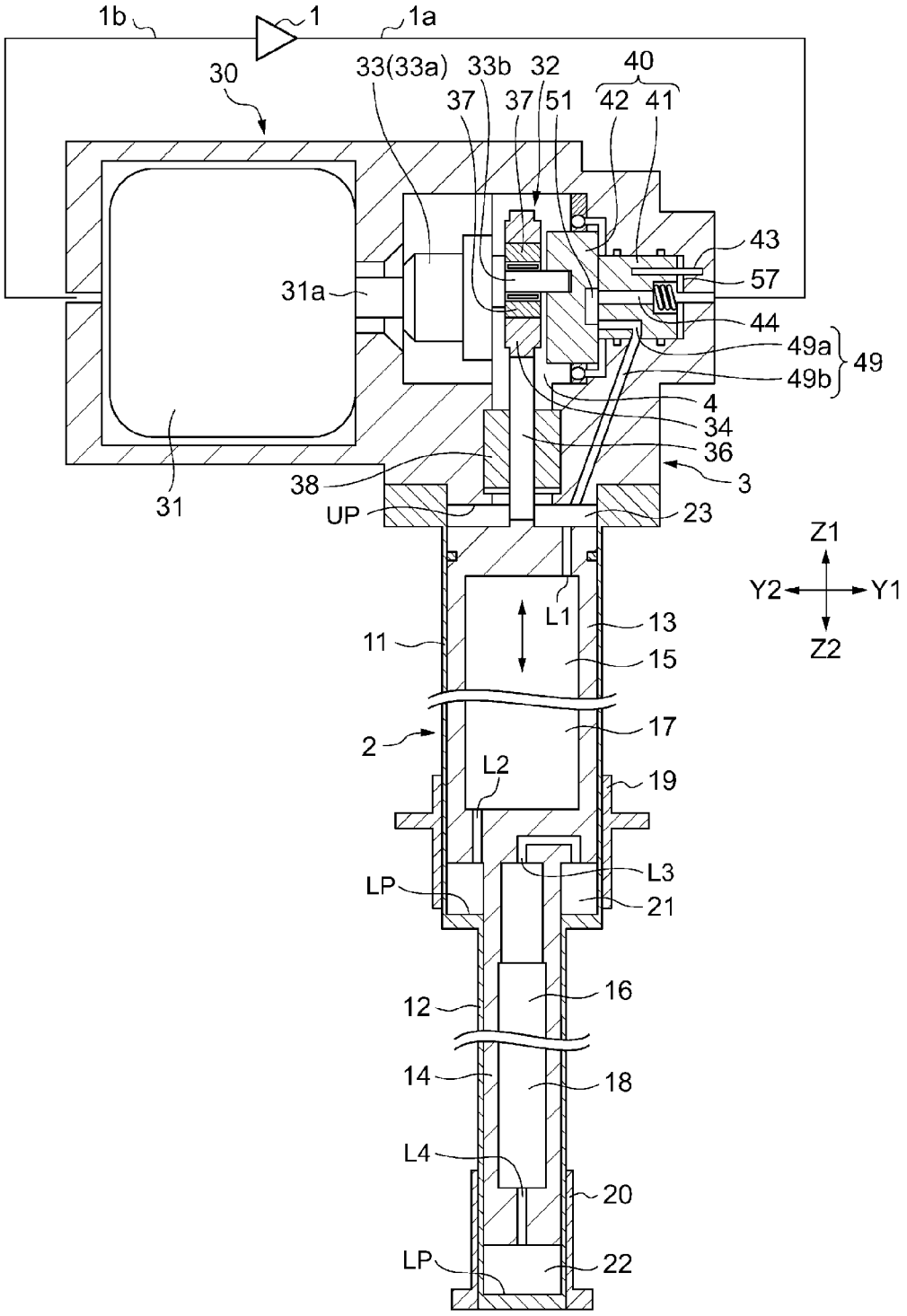
FIG. 1 is a cross-sectional view of a GM refrigerator according to an embodiment of the present invention.
Figure 2:
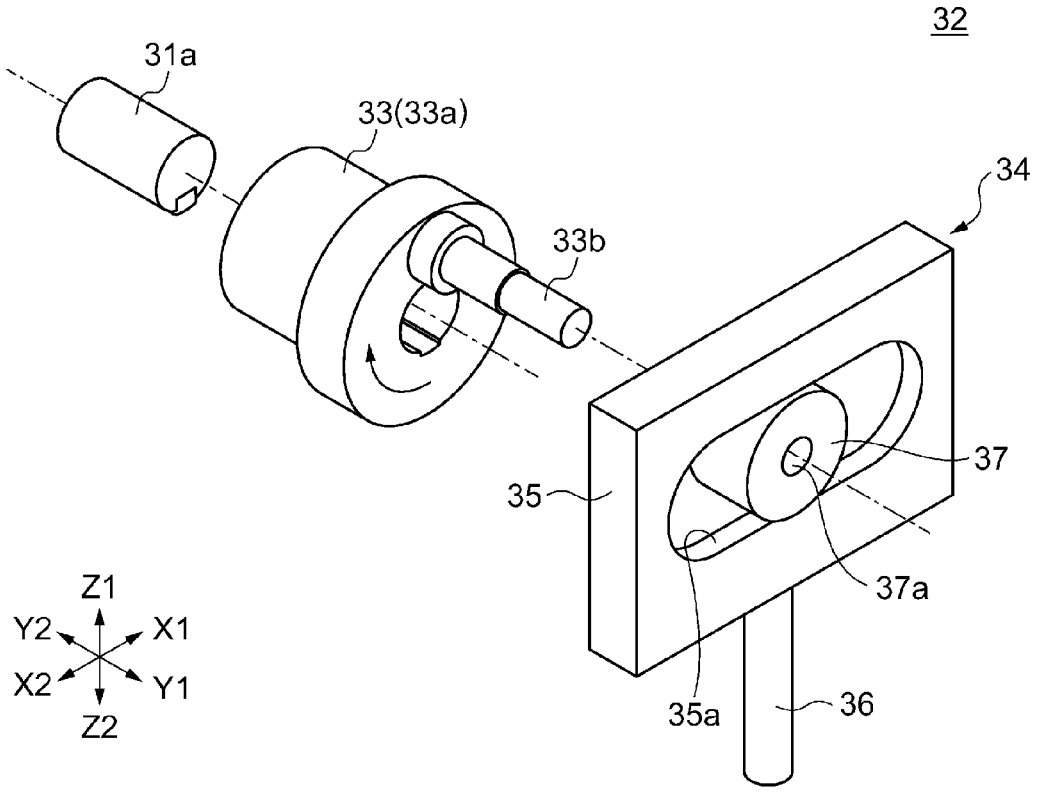
FIG. 2 is an exploded perspective view illustrating an enlarged scotch yoke mechanism.
Figure 3:
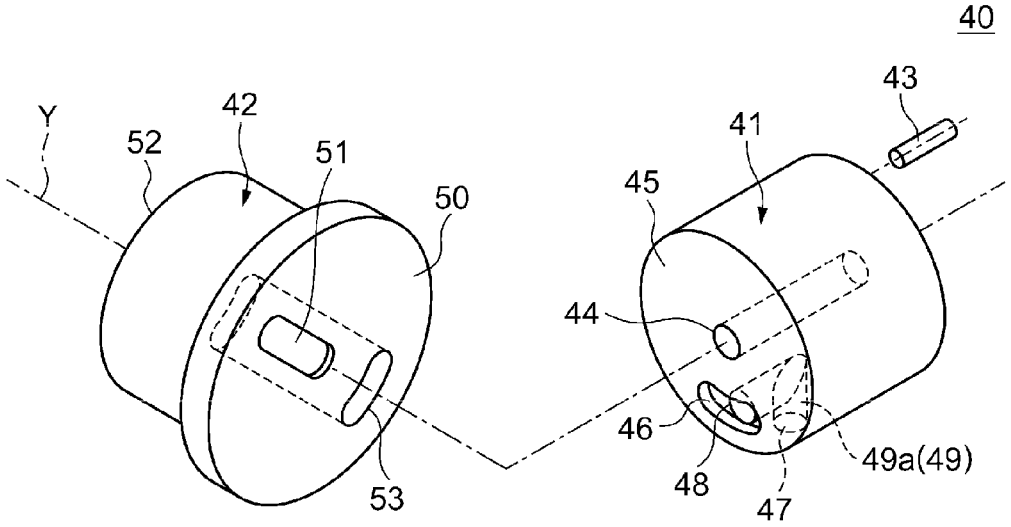
FIG. 3 is an exploded perspective view illustrating an enlarged rotary valve.

First, an entire configuration of a cryogenic refrigerator according to the embodiment will be described. FIGS. 1 to 3 are diagrams for describing the cryogenic refrigerator according to an embodiment of the present invention. According to the present embodiment, a Gifford McMahon refrigerator (hereinafter referred to as a GM refrigerator) will be described as an example of the cryogenic refrigerator. The GM refrigerator according to the present embodiment includes a compressor 1, a cylinder 2, a housing 3, and so on.

The compressor 1 collects low-pressure refrigerant gas from an intake side connected to a low-pressure pipe 1*b*. After compressing the collected refrigerant gas, the compressor 1 supplies high-pressure refrigerant gas to a high-pressure pipe 1*a* connected to a discharge side. Helium gas may be used as the refrigerant gas, but not limited thereto.

In the present embodiment, a two-stage GM refrigerator will be exemplified for description. In the two-stage GM refrigerator, the cylinder 2 includes two cylinders formed of a first-stage cylinder 11 and a second-stage cylinder 12. A first-stage displacer 13 is inserted into the first-stage cylinder 11. Also, a second-stage displacer 14 is inserted into the second-stage cylinder 12.

This first-stage displacer 13 and the second-stage displacer 14 are connected each other, and respectively configured capable of reciprocating in the cylinder shaft direction inside the first-stage cylinder 11 and the second-stage cylinder 12. An internal space 15 and an internal space 16 are respectively formed inside the first-stage displacer 13 and the second-stage displacer 14. The internal space 15 and the internal space 16 are filled with regenerator material and function as a regenerator 17 and a regenerator 18.

The first-stage displacer 13 positioned at an upper portion is connected to a drive shaft 36 extending upward (in a Z1 direction). This drive shaft 36 partially forms a scotch yoke mechanism 32 described later.

Further, a gas flow passage L1 is formed at a high-temperature end side (end portion on the Z1 direction side) of the first-stage displacer 13. Additionally, a gas flow passage L2 that allows the internal space 15 to communicate with a first-stage expansion space 21 is formed on a low-temperature end side (end portion on Z2 direction side) of the first-stage displacer 13.

The first-stage expansion space 21 is formed at an end portion on the low-temperature side of the first-stage cylinder 11 (end portion on the side of the direction indicated by the arrow Z2 in FIG. 1). Further, an upper chamber 23 is formed at an end portion on the high-temperature side of the first-stage cylinder 11 (end portion on the side of the direction indicated by the arrow Z1 in FIG. 1).

Additionally, a second-stage expansion space 22 is formed at an end portion on the low-temperature side inside the second-stage cylinder 12 (end portion on the side of the direction indicated by the arrow Z2 in FIG. 1).

The second-stage displacer 14 is attached to a lower portion of the first-stage displacer 13 by a joint mechanism not illustrated. A gas flow passage L3 that allows the first-stage expansion space 21 to communicate with the internal space 16 is formed at an end portion on the high-temperature side (end portion on the side of the direction indicated by the arrow Z1 in FIG. 1) of this second-stage displacer 14. Further, a gas flow passage L4 that allows the internal space 16 to communicate with the second-stage expansion space 22 is formed at an end portion on the low-temperature side (end portion on the side of the direction indicated by the arrow Z2 in FIG. 1) of the second-stage displacer 14.

A first cooling stage 19 is disposed at a position facing the first-stage expansion space 21 on an outer peripheral surface of the first-stage cylinder 11. A second cooling stage 20 is disposed as a position facing the second-stage expansion space 22 on an outer peripheral surface of the second-stage cylinder 12.

The above-mentioned first-stage displacer 13 and second-stage displacer 14 respectively move in a vertical direction in the drawing (in the directions of the arrows Z1 and Z2) inside the first-stage cylinder 11 and the second-stage cylinder 12 by means of the scotch yoke mechanism 32.

FIG. 2 is a view illustrating the enlarged scotch yoke mechanism 32. The scotch yoke mechanism 32 includes a crank 33, a scotch yoke 34, and so on. This scotch yoke mechanism 32 is driven by a driving unit such as a motor 31.

The crank 33 is fixed to a rotary shaft (hereafter referred to as a driving rotary shaft 31*a*) of the motor 31. This crank 33 includes a crank pin 33*b* at a position eccentric from where the driving rotary shaft 31*a* is fixed. Therefore, when the crank 33 is attached to the driving rotary shaft 31*a*, the crank pin 33*b* becomes eccentric with respect to the driving rotary shaft 31*a*. In this view, the crank pin 33*b* functions as an eccentric rotating body.

The scotch yoke 34 includes the drive shaft 36, a yoke plate 35, a roller bearing 37, and so on. A housing space 4 is formed inside the housing 3. The housing space 4 is configured as an airtight container housing the scotch yoke 34, and a rotor valve 42 of the rotary valve 40 described below, and so on and having airtightness. This housing space 4 communicates with an intake port of the compressor 1 via the low-pressure pipe 1*b*. Therefore, pressure inside the housing space 4 is constantly kept low.

The drive shaft 36 extends downward (in the Z2 direction) from the yoke plate 35. This drive shaft 36 is supported by a sliding bearing 38 provided inside the housing 3. Therefore, the drive shaft 36 is also configured movable in the vertical direction in the drawing (in the directions of the arrows Z1 and Z2 in the drawing).

Since the drive shaft 36 is supported by the sliding bearing 38, the scotch yoke 34 is movable in the vertical direction (in the directions of the arrows Z1 and Z2 in the drawing) inside the housing 3.

It should be noted here that, according to the present embodiment, a term "shaft direction" may be used to clearly express a positional relationship of the components of the cryogenic refrigerator. The shaft direction is a direction in which the drive shaft 36 extends and conforms to the direction that the displacers 13 and 14 move. For the sake of convenience, a position relatively close to the expansion space or the cooling stage may be referred to as a "lower side" and a position relatively distant may be referred to as an "upper side" in relation to the shaft direction. In other words, a position relatively distant from the end portion of the low-temperature side may be referred to as an "upper side" and a position relatively close thereto may be referred to as a "lower side". It should be noted here that terms are not related to placement when the GM refrigerator is mounted. For instance, the GM refrigerator may be vertically mounted with the expansion space facing upward.

A horizontally long window 35*a* is formed at the yoke plate 35. This horizontally long window 35*a* extends in a direction intersecting with the direction in which the drive shaft 36 extends, for instance, in an orthogonal direction (directions of arrows X1 and X2 in FIG. 2).

The roller bearing 37 is disposed inside the horizontally long window 35*a*. The roller bearing 37 is configured rollable inside the horizontally long window 35*a*. Further, a hole 37*a* to be engaged with the crank pin 33*b* is formed at a center position of the roller bearing 37. The horizontally long window 35*a* permits lateral movement of the crank pin 33*b* and the roller bearing 37. The horizontally long window 35*a* includes an upper frame portion and a lower frame portion both extending in the lateral direction, and further includes a first side frame portion and a second side frame portion which extend in the shaft direction or the vertical direction at respective horizontal end portions of the upper frame portion and the lower frame portion, and connect the upper frame portion with the lower frame portion.

When the motor 31 is driven and the driving rotary shaft 31*a* starts rotating, the crank pin 33*b* rotates as though drawing a circular arc. With this movement, the scotch yoke 34 reciprocates in the directions of the arrows Z1 and Z2 in the drawing. At this point, the roller bearing 37 reciprocates inside the horizontally long window 35*a* in the direction of the arrows X1 and X2 in the drawing.

The first-stage displacer 13 is connected to the drive shaft 36 connected to a lower portion of the scotch yoke 34. Therefore, when the scotch yoke 34 reciprocates in the directions of the arrows Z1 and Z2 in the drawing, the first-stage displacer 13 and the second-stage displacer 14 connected thereto also reciprocate in the directions of the arrows Z1 and Z2 in the first-stage cylinder 11 and the second-stage cylinder 12.

Next, a valve mechanism will be described. According to the present embodiment, the rotary valve 40 is used as the valve mechanism.

The rotary valve 40 switches the flow passage of the refrigerant gas. The rotary valve 40 functions as a supply valve that guides the high-pressure refrigerant gas discharged from the discharge side of the compressor 1 to the upper chamber 23 of the first-stage displacer 13. The rotary valve 40 also functions as a discharge valve that guides the refrigerant gas from the upper chamber 23 to the intake side of the compressor 1.

This rotary valve 40 includes a stator valve 41 and a rotor valve 42 as illustrated in FIG. 3 as well as in FIG. 1. The stator valve 41 includes a flat stator-side sliding surface 45. The rotor valve 42 also includes a flat rotor-side sliding surface 50. Accordingly, this stator-side sliding surface 45 and the rotor-side sliding surface 50 contact by surfaces, thereby preventing the refrigerant gas from leaking.

The stator valve 41 is fixed inside the housing 3 with a fixing pin 43. The stator valve 41 is fixed with the fixing pin 43, thereby restricting rotation of the stator valve 41.

A fitting hole (not illustrated) to be fitted with the crank pin 33*b* is formed on an opposite-side end surface 52 located on the opposite side of the rotor-side sliding surface 50 of the rotor valve 42. As illustrated in FIG. 1, the crank pin 33*b* includes a tip projected from the roller bearing 37 in a direction of an arrow Y1 when inserted into the roller bearing 37.

The tip of the crankpin 33*b* projected from the roller bearing 37 is fitted into the fitting hole formed on the rotor valve 42. Accordingly, the rotor valve 42 rotates in synchronization with the scotch yoke mechanism 32 when the crank pin 33*b* rotates (eccentrically rotates).

The stator valve 41 includes a refrigerant gas supply hole 44, an arc-shaped groove 46, and a valve-side flow passage 49*a*. The refrigerant gas supply hole 44 is connected to the high-pressure pipe 1*a* of the compressor 1 and formed so as to pierce a center portion of the stator valve 41.

The arc-shaped groove 46 is formed on the stator-side sliding surface 45. The arc-shaped groove 46 has an arc shape centering the refrigerant gas supply hole 44.

The gas flow passage 49 is formed on the stator valve 41 and the housing 3. The gas flow passage 49 includes the valve-side flow passage 49*a* formed inside the stator valve 41, and a housing-side flow passage 49*b* formed inside the housing 3.

An opening portion 48 open into the arc-shaped groove 46 is formed at one end portion of the valve-side flow passage 49*a*. Also, as illustrated in FIG. 3, the other end portion 47 of the valve-side flow passage 49*a* is open to a side surface of the stator valve 41.

The other end portion 47 of the valve-side flow passage 49*a* communicates with one end portion of the housing-side flow passage 49*b*. Further, the other end portion of the housing-side flow passage 49*b* is connected to the first-stage expansion space 21 via the upper chamber 23, gas flow passage L1, regenerator 17, and so on.

On the other hand, the rotor valve 42 includes an oval shape groove 51 and an arc shape hole 53.

The oval shape groove 51 is formed on the rotor-side sliding surface 50 so as to extend in the radial direction from the center thereof. Further, the arc shape hole 53 pierces the rotor valve 42 from the rotor-side sliding surface 50 to the opposite-side end surface 52 and is connected to the housing space 4. The arc shape hole 53 is formed so as to be positioned at the same circumference as the arc-shaped groove 46 of the stator valve 41.

A supply valve is formed of the above-described refrigerant gas supply hole 44, oval shape groove 51, arc-shaped groove 46, and opening portion 48. Further, an exhaust valve is formed of the opening portion 48, arc-shaped groove 46, and arc shape hole 53. According to the present embodiment, the spaces which exist inside the valves, such as the oval shape groove 51 and arc-shaped groove 46, may be collectively referred to as a valve internal space.

In the GM refrigerator thus configured, the scotch yoke 34 reciprocates in the Z1 and Z2 directions when the scotch yoke mechanism 32 is driven by the motor 31. With the movement of this scotch yoke 34, the first-stage displacer 13 and the second-stage displacer 14 respectively reciprocate between a top dead center and a bottom dead center inside the first-stage cylinder 11 and the second-stage cylinder 12.

When the first-stage displacer 13 and the second-stage displacer 14 reach the bottom dead center, the exhaust valve closes and the supply valve opens. In other words, the refrigerant gas flow passage is formed between the refrigerant gas supply hole 44, oval shape groove 51, arc-shaped groove 46, and gas flow passage 49.

Accordingly, high-pressure refrigerant gas starts being filled into the upper chamber 23 from the compressor 1. Subsequently, the first-stage displacer 13 and the second-stage displacer 14 start moving upward passing the bottom dead center, and the refrigerant gas passes the regenerator 17 and the regenerator 18 from the upper side to the lower side to be filled into the first-stage expansion space 21 and the second-stage expansion space 22.

When the first-stage displacer 13 and the second-stage displacer 14 reach the top dead center, the supply valve closes and the exhaust valve opens. In other words, the refrigerant gas flow passage is formed between the gas flow passage 49, arc-shaped groove 46, and arc shape hole 53.

Due to this, the high-pressure refrigerant gas expands inside the first-stage expansion space 21 and the second-stage expansion space 22, thereby generating frigidity and cooling the respective cooling stages 19 and 20. Further, the low-temperature refrigerant gas having generated frigidity flows from the lower side to the upper side while cooling the regenerator material inside the regenerator 17 and the regenerator 18, and then flows return to the low-pressure pipe 1*b* of the compressor 1.

When the first-stage displacer 13 and the second-stage displacer 14 reach the bottom dead center, the exhaust valve closes and the supply valve opens, and at this point one cycle finishes. By thus repeating the cycle of compression and expansion for the refrigerant gas, the cooling stage 19 and the cooling stage 20 of the GM refrigerator are cooled to cryogenic temperature. The cooling stage 19 and the cooling stage 20 of the GM refrigerator respectively conduct the frigidity generated by expanding the refrigerant gas inside the first-stage expansion space 21 and the second-stage expansion space 22 to the outside of the first-stage cylinder 11 and the second-stage cylinder 12.

As described above, in the GM refrigerator according to an embodiment, the driving unit such as motor 31 converts rotary movement of the crank 33 to reciprocating movement in the shaft direction of the scotch yoke mechanism 32. Therefore, lateral movement other than reciprocating movement is also added to the yoke plate 35 inside the scotch yoke mechanism 32. In the following, rotation suppressing force that suppresses movement other than the reciprocating movement in the scotch yoke mechanism 32 will be described.

Figure 4A:
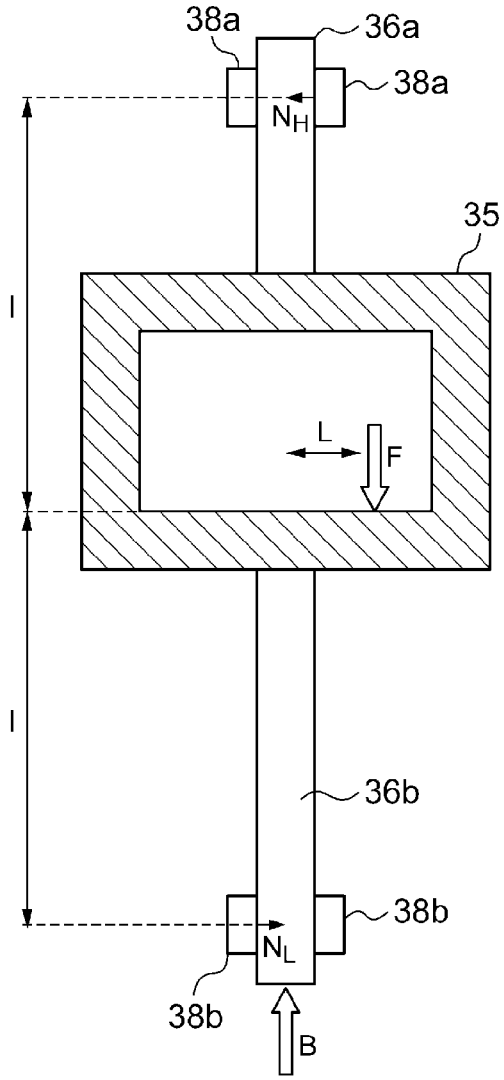
FIGS. 4A and 4B are diagrams for describing rotation suppressing force at a scotch yoke according to a related art.
Figure 4B:
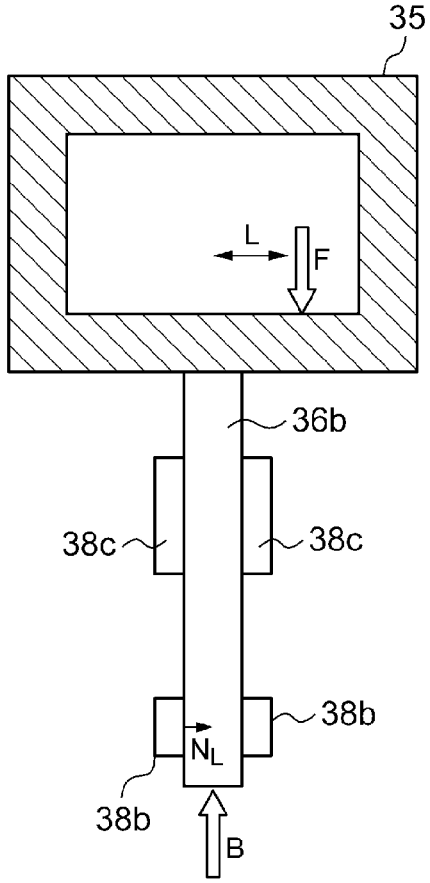

FIGS. 4A and 4B are diagrams for describing rotation suppressing force at a scotch yoke 34 according to a related art. The scotch yoke 34 receives force applied from the driving unit such as the motor 31 at a position deviated from the drive shaft 36 which is a linear drive shaft because of its characteristics. Therefore, the drive shaft 36 of the scotch yoke 34 is applied with force to rotate or tilt around the driving rotary shaft 31*a* of the driving unit as a rotary shaft (hereinafter the drive shaft 36 rotating or tilting around the driving rotary shaft 31*a* as the rotary shaft may be referred to as "rolling" of the drive shaft 36). Generally, the scotch yoke 34 includes a bearing mechanism to suppress such rolling force.

As illustrated in FIG. 4A, in a scotch yoke 34 according to the related art, a drive shaft 36*a* extends upward from a yoke plate 35 and is supported by a sliding bearing 38*a*. Accordingly, the drive shaft 36*a* is movable in the vertical direction in the drawing. Further, a drive shaft 36*b* extends downward from the yoke plate 35 and is supported by a sliding bearing 38*b*. In the scotch yoke 34 according to the related art, the sliding bearing 38*a* and the sliding bearing 38*b* are formed as the bearing mechanism to suppress the rolling force.

To simplify description, thickness of the drive shaft 36*a* and the drive shaft 36*b* are ignored here. In FIG. 4A, assume that the yoke plate 35 receives force F applied from a driving unit at a position deviated from the drive shaft 36*a* and the drive shaft 36*b* by distance L. The force F has the same magnitude as a load B caused by pressure loss at the both ends of the first-stage displacer 13 and the second-stage displacer 14 not illustrated in FIG. 4A.

In FIG. 4A, drag force which the sliding bearing 38*a* and the sliding bearing 38*b* respectively receive from the drive shaft 36*a* and the drive shaft 36*b* are defined as $N_H$ and $N_L$, and a relation is to be $N_H=N_L=N$. Further, the rotation suppressing force that suppresses the rolling force of the drive shaft 36 of the scotch yoke 34 is defined as $N_B$. At this point, the rotation suppressing force $N_B$ is: $N_B=2\times1\times N$. Here, 1 represents the distance from a position of receiving the force applied from the driving unit on the yoke plate 35 to the sliding bearing 38*a* or the sliding bearing 38*b*.

Here, the smaller N is, the smaller the drag force related to the sliding bearing 38*a* and the sliding bearing 38*b* is, and therefore the rolling force of the drive shaft 36 can be suppressed with a small load. In other words, the longer the distance 1 from the position of receiving the force F applied from the driving unit on the yoke plate 35 to the sliding bearing 38*a* or the sliding bearing 38*b* is, the more the rolling power of the drive shaft 36 can be suppressed with the small load.

Therefore, in the scotch yoke 34 according to the related art, the drive shaft 36*a* and the drive shaft 36*b* are respectively provided in the upper and lower directions of the yoke plate 35, and an effective length 1 for securing the rotation suppressing force $N_B$ is elongated. However, in the case of having such a configuration, the entire length of the refrigerator becomes long because it is necessary to house the drive shaft 36*a* at the upper portion of yoke plate 35 inside the refrigerator.

FIG. 4B is a diagram for describing rotation suppressing force at a scotch yoke 34 according to a different related art. In the scotch yoke illustrated in FIG. 4B, a drive shaft 36*a* at an upper portion of a yoke plate 35 and a sliding bearing 38*a* are eliminated in consideration of the problem in FIG. 4A, and rolling of a drive shaft 36 is suppressed by a sliding bearing 38*b* of a drive shaft 36*b* at a lower portion of a yoke plate 35. Since the drive shaft 36*a* and the sliding bearing 38*a* do not exist, the drag force $N_L$ related to the sliding bearing 38*b* becomes large, compared to the case illustrated in FIG. 4A. Therefore, the scotch yoke 34 according the different related art illustrated in FIG. 4B is provided with a sub-guide 38*c* at the lower portion of the yoke plate 35 in addition to the sliding bearing 38*b*, thereby suppressing the rolling force of the drive shaft 36.

However, according to the configuration in which the guide for generating the rotation suppressing force is provided at the lower portion of the yoke plate 35, a certain degree of length is necessary to cope with the rolling force of the drive shaft 36. As a result, the entire length of the drive shaft 36*b* at the lower portion of the yoke plate 35 becomes long, and consequently the entire length of the refrigerator becomes long, too. Further, in the configuration where the guide for generating the rotation suppressing force is provided at the lower portion of the yoke plate 35, sufficient rotation suppressing power may not be obtained.

To solve such a problem, first the drive shaft 36*a* and the sliding bearing 38*a* both provided at the upper portion of the yoke plate 35 are eliminated in a scotch yoke 34 according to an embodiment. Then, in the scotch yoke 34 according to the embodiment, a mechanism for suppressing rolling power of the drive shaft 36 is provided on the yoke plate 35 at a position higher than the position of receiving the force F applied from the driving unit. In the following, the scotch yoke 34 according to the embodiment will be described in detail.

FIGS. 5A to 5D are diagrams for describing a guide mechanism that restricts movement of a yoke plate 35 in the scotch yoke 34 inside a housing space 4. It should be noted that a single-stage GM refrigerator is illustrated in FIGS. 5A to 5D in order to simplify the description while the two-stage GM refrigerator is illustrated in FIG. 1. More specifically, FIGS. 5A to 5D schematically illustrate the single-stage GM refrigerator including the scotch yoke 34, a housing 3 that houses the scotch yoke 34, a first-stage cylinder 11, a first-stage displacer 13, and a regenerator 17. However, a man skilled in the art can easily understand that the present invention may be achieved even in a two-stage GM refrigerator.

Figure 5A:
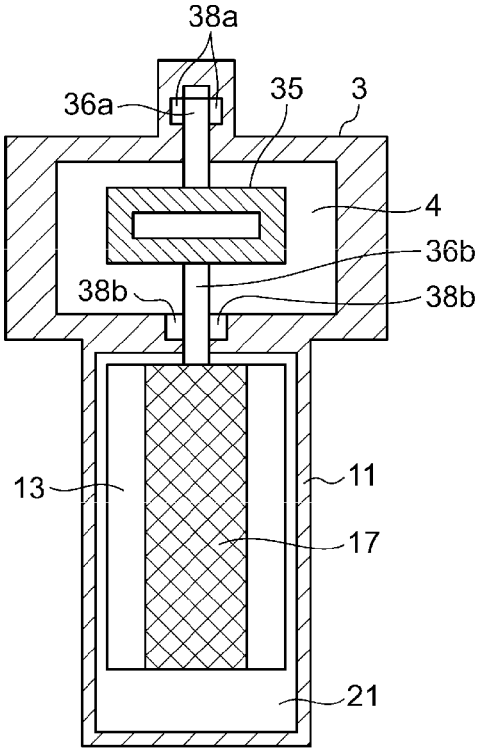
FIGS. 5A to 5D are diagrams for describing a guide mechanism that restricts rotation of a yoke plate in a scotch yoke inside a housing space.

FIG. 5A is a diagram illustrating a simplified cross-section of the GM refrigerator according to the related art for comparison, corresponding to the above-described diagram in FIG. 4A. As described with reference to FIG. 4A, in the example illustrated in FIG. 5A, a drive shaft 36*a* and a sliding bearing 38*a* are provided at an upper portion of the yoke plate 35, and the housing 3 has a projected portion to house the mentioned components. Meanwhile, an example of the entire length of the two-stage GM refrigerator according to an embodiment is about 50 cm although not limited thereto. In this entire length, a length of the projected portion to house the drive shaft 36*a* and the sliding bearing 38*a* in the housing 3 is about 7 cm in the direction of the entire length. Therefore, approximately 10 percent of the entire length of the two-stage GM refrigerator is the portion to house the drive shaft 36*a* and the sliding bearing 38*a*. This indicates that the length of the scotch yoke 34 including the drive shaft 36 largely contributes to the entire length of the refrigerator.

Figure 5B:
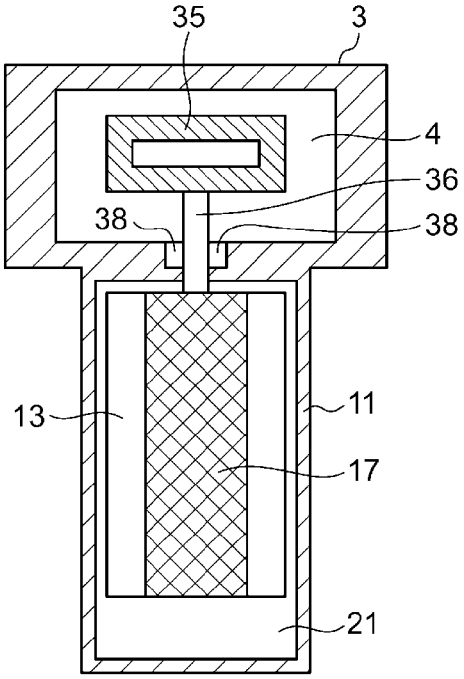

FIG. 5B is a diagram illustrating a simplified cross-section of the GM refrigerator in the case where the drive shaft 36*a* and the sliding bearing 38*a* at the upper portion of the yoke plate 35 are eliminated. Since the GM refrigerator illustrated in FIG. 5B does not have the projected portion to house the drive shaft 36*a* and the sliding bearing 38*a* in the housing 3, the entire length becomes shorter compared to the GM refrigerator illustrated in FIG. 5A. However, the only portion that suppresses rolling force of the drive shaft 36 is the sliding bearing 38, and therefore, sufficient rotation suppressing force may not be obtained.

Also, as described above, the housing space 4 is an airtight container and the sliding bearing 38 includes sealing to keep airtightness of the housing space 4. As illustrated in FIG. 5B, in the case where the only portion that suppresses the rolling force of the drive shaft 36 is the sliding bearing 38, a large amount of load is concentrated on the sliding bearing 38. As a result, in the case of operating the GM refrigerator for a long period, sealing property may be deteriorated due to wear of the sliding bearing 38.

Considering that, a guide mechanism 60 that restricts movement of the yoke plate 35 is provided as a portion of the housing space 4 in the GM refrigerator according to the embodiment.

Figure 5C:
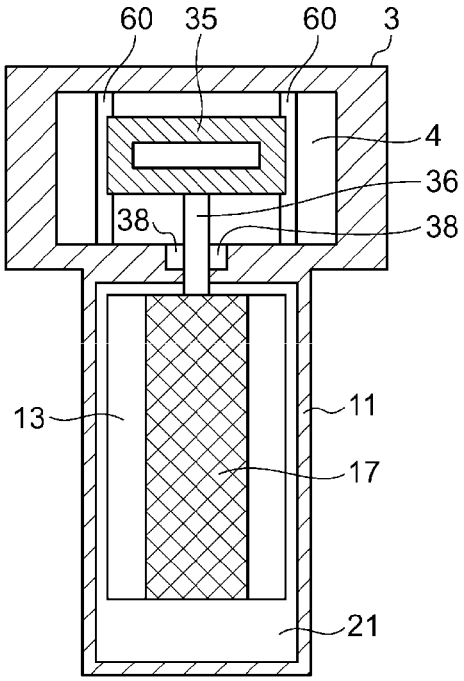

FIG. 5C is a diagram illustrating the guide mechanism 60 that restricts movement of the yoke plate 35 according to the embodiment. As illustrated in FIG. 5C, the guide mechanism 60 is formed as a portion of the housing space 4 inside the housing 3. The guide mechanism 60 restricts movement other than reciprocating movement of the yoke plate 35 inside the housing space 4. Since the guide mechanism 60 is formed as a portion of the housing space 4, at least a portion of the guide mechanism 60 exists higher than a position of receiving the force F applied from the driving unit on the yoke plate 35. The guide mechanism 60 is mounted so as to support a side portion of the yoke plate 35 such that tilting of the yoke plate 35 around the rotary shaft of the crank 33 is restricted. With this configuration, rolling force of the drive shaft 36 and the yoke plate 35 can be suppressed. In the following, a surface mounted with the guide mechanism 60, out of the surfaces of the yoke plate 35, may be referred to as "guide mounting surface". As described in detail later, it should be noted that the guide mechanism 60 that restricts movement of the yoke plate 35 is disposed more inside than the side surface of the yoke plate 35. Therefore, in the present specification, the "side portion" of the yoke plate 35 is not limited to the side surface of the yoke plate 35, and an area more inside from the side surface of the yoke plate 35 is included as well.

Further, the yoke plate 35 reciprocates inside the housing space 4. Due to this, a surface, out of the surfaces constituting the yoke plate 35, located on the opposite side of the first-stage displacer 13 (hereinafter may be referred to as an "upper surface of the yoke plate 35") is separated from a wall surface, out of the wall surfaces constituting the housing space 4, facing the upper surface of the yoke plate 35 (hereinafter may be referred to as an "upper surface of the housing space 4"). The upper surface of the housing space 4, out of the wall surfaces constituting the housing space 4, may be also expressed as an opposite-side surface with respect to the first-stage cylinder 11. When the first-stage displacer 13 is at the top dead center, the upper surface of the yoke plate 35 may contact the upper surface of the housing space 4, but when the first-stage displacer 13 is at the top dead center, the upper surface of the yoke plate 35 is preferably separated from the upper surface of the housing space 4. In such a case, the guide mechanism 60 restricts movement other than the reciprocating movement of the yoke plate 35 only at a position lower than the upper surface of the housing space 4.

Figure 6A:
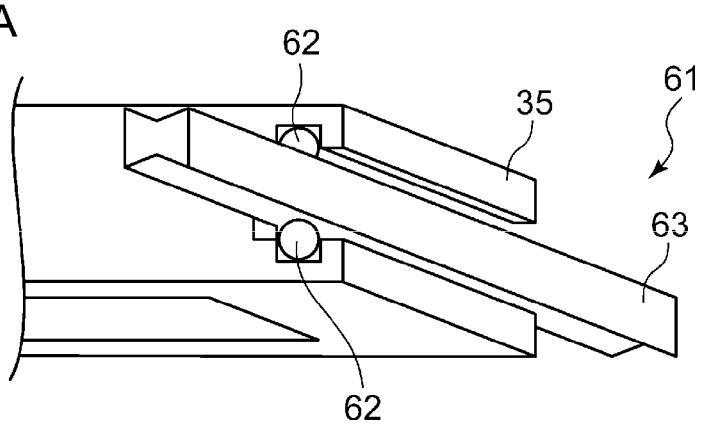
FIGS. 6A to 6C are views for describing in detail an example of the guide mechanism that restricts rotation of the yoke plate in the scotch yoke.
Figure 6B:
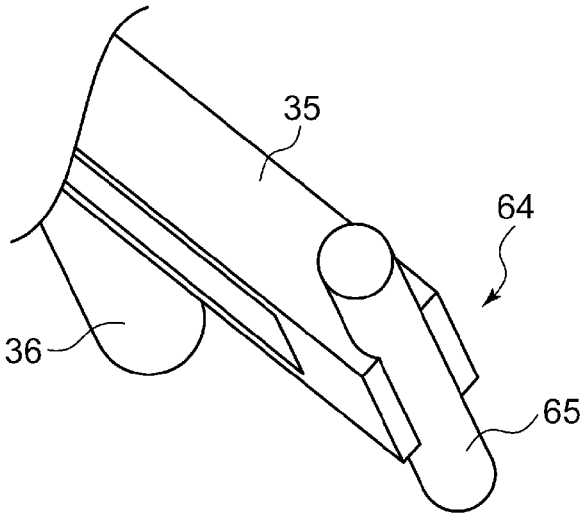
Figure 6C:
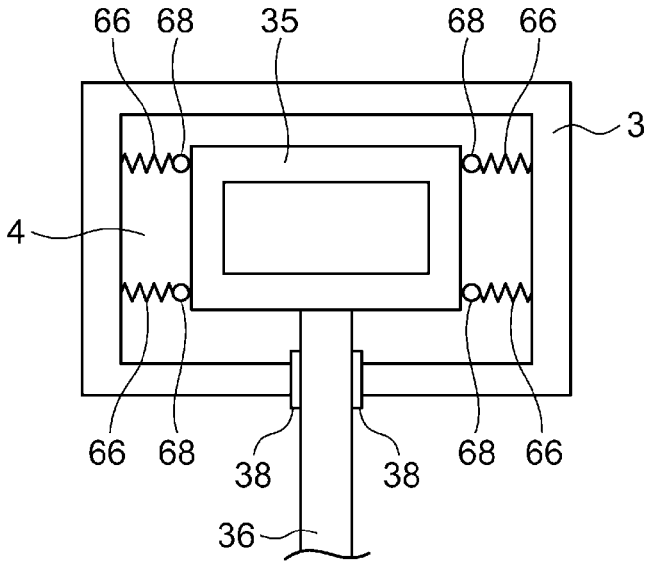

FIGS. 6A to 6C are views for describing more in detail an example of the guide mechanism 60 that restricts movement of the yoke plate 35 in the scotch yoke 34. More specifically, FIG. 6A is a view illustrating a case in which the guide mechanism 60 is implemented by using a linear guide mechanism 61. As illustrated in FIG. 6A, a groove is formed on a guide mounting surface out of the surfaces of the yoke plate 35, and a rail 63 is inserted to the groove. The rail 63 is supported by an upper wall and a lower wall of the housing space 4 and extends in a direction the yoke plate 35 reciprocates. Further, a plurality of balls 62 is inserted between the yoke plate 35 and the rail 63, and the yoke plate 35 is configured to roll along the rail 63. The linear guide mechanism 61 functions as a rolling unit that causes the yoke plate 35 to reciprocate. By thus configuring the linear guide mechanism 61, rolling force of the drive shaft 36 and the yoke plate 35 can be suppressed. Further, yawing of the yoke plate 35 whereby the yoke plate rotates around the drive shaft 36 as a rotary shaft can be suppressed, too. Moreover, pitching of the yoke plate 35 whereby the yoke plate rotates around the X1 or X2 directions in FIG. 1 as the rotary shaft can be also suppressed.

FIG. 6B is a view illustrating a case in which the guide mechanism 60 is implemented by using a side guide structure 64. As is the case with FIG. 6A, a groove is formed on a guide mounting surface of the yoke plate 35, and a rod 65 supported by the upper and lower walls of the housing space 4 is inserted to the groove. However, in the exemplary case illustrated in FIG. 6B, no ball is provided between the yoke plate 35 and the rod 65 unlike the case illustrated in FIG. 6A, and the yoke plate 35 and the rod 65 are configured to slide. In other words, the side guide structure 64 illustrated in FIG. 6B functions as a sliding unit that causes the yoke plate 35 to reciprocate. It should be noted that a cross-section of the rod 65 is not limited to a circle shape but may be other shapes such as a rectangle or an oval although FIG. 6B illustrates the case of adopting a cylindrical rod having a circle-shape cross section as the rod 65.

As described above, the housing space 4 communicates with the intake port of the compressor 1 via the low-pressure pipe 1*b*. That means that the housing space 4 partially forms a space where the refrigerant gas circulates. Therefore, there is possibility of causing contamination in a circulation line in the case of using lubricant such as grease between the groove of the yoke plate 35 and the rod 65.

Considering above, in the side guide structure 64 using the rod 65 according to the embodiment, a sliding surface included in the rod 65 and contacting the groove of the yoke plate 35 is coated with a film having lubricating property. In the same manner, a contact surface included in the yoke plate 35 and contacting the rod 65 may be also coated with the film having lubricating property. At least one or both of the sliding surface included in the rod 65 and contacting the groove of the yoke plate 35 and the contact surface included in the yoke plate 35 and contacting the rod 65 may be coated with the film having lubricating property. This can reduce friction caused on the sliding surface between the rod 65 and the yoke plate 35 without using the lubricant like grease. The film having lubricating property can be implemented by using a rigid film, for example, fluorine resin, Diamond-Like Carbon (DLC), and so on. By thus configuring the side guide structure 64, the rolling force of the drive shaft 36 and the yoke plate 35 can be suppressed. Further, yawing of the yoke plate 35 whereby the yoke plate rotates around the drive shaft 36 as the rotary shaft, and pitching of the yoke plate 35 whereby the yoke plate moves in the X1 or X2 direction can be also suppressed.

FIG. 6C is a diagram illustrating a holding mechanism for the yoke plate 35, using a spring 66 and a sliding pin joint 68. As illustrated in FIG. 6C, the spring 66 for restricting movement of the yoke plate 35 is provided on a wall surface, out of the wall surfaces of the housing space 4, facing the guide mounting surface on the yoke plate 35. The spring 66 and the yoke plate 35 contact each other via the sliding pin joint 68 having a spherical shape. With this configuration, rolling force of the drive shaft 36 and the yoke plate 35 can be suppressed because elastic force of the spring 66 acts as drag force. Further, since the spring 66 and the yoke plate 35 contact each other via the spherical sliding pin joint 68, friction caused by reciprocating movement of the yoke plate 35 is reduced.

As it has been described above referring to FIGS. 6A to 6C, movement of the yoke plate 35, other than reciprocating movement, can be restricted by the guide mechanism provided inside the housing space 4.

Meanwhile, the wall surface of the housing 3 forming the housing space 4 may be used as the guide mechanism for restricting movement of the yoke plate 35, instead of the inside of the housing space 4.

Figure 5D:
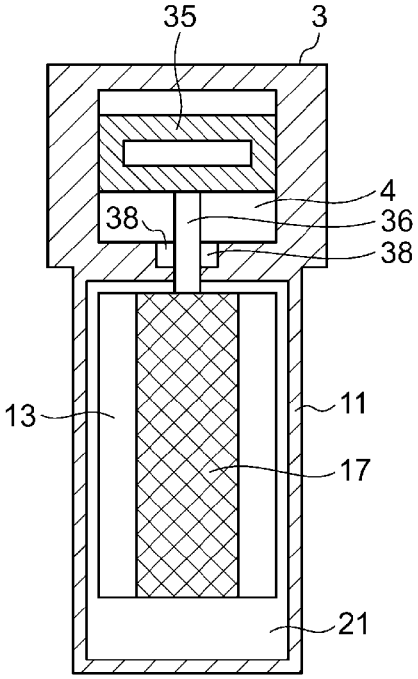

Back to description for FIG. 5, FIG. 5D is a diagram illustrating an exemplary case in which the wall surface of the housing space 4 is utilized as the guide mechanism. As illustrated in FIG. 5D, the guide mounting surface of the yoke plate 35 contacts the wall surface of the housing space 4. Because of this, the wall surface of housing space 4 becomes the guide mechanism that restricts the rolling force of the drive shaft 36 and the yoke plate 35.

In the example illustrated in FIG. 5D, the size of the yoke plate 35 does not differ from that of the example in FIG. 5C when compared. Accordingly, in the example illustrated in FIG. 5D, the housing space 4 is made small before the wall surface of the housing space 4 contacts the yoke plate 35, compared to the example in FIG. 5C. This provides an effect of downsizing the GM refrigerator in the example illustrated in FIG. 5D. It should be noted that, in the example illustrated in FIG. 5D, it is preferable to coat the guide mounting surface on the yoke plate 35 and a portion included in the wall surfaces of the housing space 4 and contacting with the yoke plate 35 with a film having lubricating property to reduce friction, such as fluorine resin.

Further, although not illustrated, the yoke plate 35 may be upsized before the wall surface of the housing space 4 contacts the yoke plate 35, instead of downsizing the housing space 4 before the wall surface of the housing space 4 contacts the yoke plate 35. Or else, the yoke plate 35 may be formed large before the yoke plate 35 contacts the wall surface of the housing space 4 and further the housing space 4 may be formed small.

Thus, rolling force of the drive shaft 36 and the yoke plate 35 can be suppressed by generating drag force on the wall surface of housing space 4. Although not illustrated, the guide mechanism may be provided on the wall surface of the housing space 4 in order to suppress yawing of the yoke plate 35 whereby the yoke plate rotates around the drive shaft 36 as the rotary shaft. This can be achieved by, for example, providing a groove on the wall surface of the housing space 4 such that the yoke plate 35 is fitted into the groove so as to be freely reciprocate in the groove. Further, a projected portion may be formed on the wall surface of the housing space 4 and a groove may be formed on the yoke plate 35 such that the projected portion can be fitted into the groove. The projected portion may be formed retractably with respect to the wall surface of the housing space 4 in order to remove the scotch yoke from the housing space 4 at the time of maintenance.

As described above, the GM refrigerator according to the embodiment can reduce the entire length of the refrigerator.

Particularly, movement of the yoke plate 35 is restricted by using the guide mechanism provided in a portion of the housing space 4, thereby achieving to suppress not only rolling force but also yawing force of the drive shaft 36 and the yoke plate 35. Further, in the case of using the wall surface of the housing space 4 as the guide mechanism, the GM refrigerator can be downsized.

While the present invention has been described based on the embodiments, it is merely illustrative of the principles and applications of the present invention Additionally, changes and many variations may be made in the embodiment without departing from the spirit of the present invention as defined by the appended claims.

It should be understood that the invention is not limited to the above-described embodiment, but may be modified into various forms on the basis of the spirit of the invention. Additionally, the modifications are included in the scope of the invention. Priority is claimed to Japanese Patent Application No. 2013-187407, filed on Sep. 10, 2013, the entire content of which is incorporated herein by reference.

What is claimed is:

1. A cryogenic refrigerator comprising:

a scotch yoke mechanism including an eccentric rotating body and a yoke plate that reciprocates by rotation of the eccentric rotating body, the yoke plate comprising a first yoke plate side surface and a second yoke plate side surface opposite the first yoke plate side surface, each of the first and second yoke plate side surfaces comprising a groove, the groove extending in a direction of the yoke plate's reciprocation;

a displacer connected to the yoke plate so as to reciprocate together with the yoke plate;

a cylinder that houses the displacer and form an expansion space for refrigerant gas in a space with the displacer; and an airtight container provided on a high-temperature side of the cylinder, and that houses the scotch yoke mechanism and receive the refrigerant gas discharged from the expansion space, wherein the airtight container includes a supporting unit that supports the first and second yoke plate side surfaces so as to restrict tilting of the yoke plate around a rotary shaft of the eccentric rotating body, wherein the supporting unit comprises a guide rail extending in the direction of the yoke plate's reciprocation and inserted into the groove, and a plurality of balls arranged within the groove and rollably held between the groove and the guide rail such that the yoke plate reciprocates along the guide rail, wherein the airtight container comprises an inner wall surface arranged in slidable contact with the first and second yoke plate side surfaces.

2. The cryogenic refrigerator according to claim 1, wherein a surface, out of the surfaces constituting the yoke plate, located on an opposite side of the displacer is separated from a wall surface of the airtight container on an opposite side of the cylinder.

3. The cryogenic refrigerator according to claim 1, wherein at least one of the inner wall surface and the first and second yoke plate side surfaces is coated with a film having lubricating property.

4. The cryogenic refrigerator according to claim 3, wherein the film having lubricating property is fluorine resin.

* * * * *